US007888993B2

(12) United States Patent
Easwaran et al.

(10) Patent No.: US 7,888,993 B2
(45) Date of Patent: Feb. 15, 2011

(54) BIAS CURRENT GENERATOR FOR MULTIPLE SUPPLY VOLTAGE CIRCUIT

(75) Inventors: Sri Navaneethakrishnan Easwaran, Freising (DE); Ingo Hehemann, Hagen a.T.W (DE)

(73) Assignee: Texas Instruments Deutschland GmbH, Freising (DE)

( * ) Notice: Subject to any disclaimer, the term of this patent is extended or adjusted under 35 U.S.C. 154(b) by 107 days.

(21) Appl. No.: 12/358,062

(22) Filed: Jan. 22, 2009

(65) Prior Publication Data

US 2009/0189647 A1 Jul. 30, 2009

(30) Foreign Application Priority Data

Jan. 24, 2008 (DE) ..... 10 2008 005 868

(51) Int. Cl.
*G05F 1/10* (2006.01)

(52) U.S. Cl. ..... 327/543; 327/77; 327/408

(58) Field of Classification Search ..... 327/88
See application file for complete search history.

(56) References Cited

U.S. PATENT DOCUMENTS 7,176,749 B2 * 2/2007 Sharma et al. ..... 327/538
7,391,595 B2 * 6/2008 Chen ..... 361/56
7,466,166 B2 * 12/2008 Date et al. ..... 327/108
7,595,685 B1 * 9/2009 Sakurai ..... 327/538
2004/0257120 A1 12/2004 Wang et al.
2006/0066387 A1 3/2006 Sharma et al.
2006/0087780 A1 4/2006 Chen

* cited by examiner

*Primary Examiner*—Lincoln Donovan
*Assistant Examiner*—Sibin Chen
(74) *Attorney, Agent, or Firm*—John J. Patti; Wade J. Brady, III; Frederick J. Telecky, Jr.

(57) ABSTRACT

An electronic device supplied by multiple supply voltages includes a bias current generating stage and maximum current selection stage. The bias current generating stage comprises a crude bias current generator for generating an crude bias current during a power up phase in which at least one of the multiple supply voltages has not yet reached its target supply voltage level, a reference current stage for providing a reference current having a target current value greater than the target value of the crude bias current when the multiple supply voltages have reached their target supply voltage levels. The maximum current selection stage is adapted to continuously output a bias current which is the maximum current of the crude bias current and the reference current.

18 Claims, 3 Drawing Sheets

BIAS CURRENT GENERATOR FOR MULTIPLE SUPPLY VOLTAGE CIRCUIT

CROSS-REFERENCE TO RELATED APPLICATIONS

This application claims priority to German Patent Application No. 102008005868.8, entitled "Bias current generator for Multiple Supply Voltage Circuit," filed on Jan. 24, 2008, which is hereby incorporated by reference for all purposes.

TECHNICAL FIELD

The invention relates generally to bias current generators and, more particularly, to bias current generation from multiple supply voltages.

BACKGROUND

Integrated electronic devices often have low voltage (LV) digital cores and medium voltage (MV) and high voltage (HV) analog cores. A problem with these electronic devices is that the different supply voltages (i.e. LV, MV and HV) are not always simultaneously available when the electronic device is switched on. Also, during continuous operation or a steady-state phase, one of the voltage supplies may not be available. An effect of missing or insufficient supply voltage levels is that the bias currents, which are generated mostly from the MV or LV supply voltages, are supplied to the different voltage domains and also absent or too low. Therefore, some nodes in the electronic device, such as the nodes in the amplifiers or IO pads can remain floating or will remain in an undefined state. This can generally result in an undesired behavior of the circuit, such as large cross currents, which may even destroy the electronic device. Some examples of convention devices are U.S. Patent Pre-Grant Publ. Nos. 2004/0257120; 2006/0066387; and 2006/0087780.

SUMMARY

According to an aspect of the present invention, an electronic device is provided that is adapted to be supplied by multiple supply voltages. The electronic device comprises a bias current generating stage. The bias current generating stage comprises a crude bias current generator for generating a crude bias current during a power up phase in which at least one of the multiple supply voltages has not yet reached its target supply voltage level. There is also a reference current stage for generating a steady state reference current having a target current value greater than the final value of the crude bias current. Furthermore, there is a current selection stage adapted to continuously adjust the bias current to a value that corresponds to the greater value of the crude bias current and the reference current. The circuitry includes a bias current generating stage having two stages, a crude bias current generator and a reference current stage. The crude bias current generator can have a rather simple architecture and should be adapted to provide a bias current if at least one of the multiple voltage supplies has a sufficiently high voltage level. However, as soon as the other supply voltage levels (e.g., LV or MV) have reached their target voltage levels or if they are close enough to their target levels, the reference current stage starts producing a reference current which is designed to have a higher target value than the target value of the current produced by the crude bias current generator.

Both current generating stages supply their currents to the current selection stage, which continuously outputs the larger of both currents. This means that, if the value of the current generated by the reference current stage exceeds the amount of current generated by the crude bias current generator, the reference current stage takes over supplying the electronic device with the required bias current. As a result, the components of the electronic device according to the present invention, like amplifiers, IO pads etc., always have bias currents during the start-up and also during the steady-state phase even if fault conditions occur. In this way, no nodes in an electronic device are floating or in an undefined state. The electronic device can preferably be an integrated electronic device.

A typical scenario to which the present invention relates is explained with respect to FIG. 1, which illustrates an exemplary setting of supply voltages in an electronic device. In a typical integrated electronic device with multiple supply voltages, a constant reference current generator may be needed in the steady state phase of the analog circuits to supply the bias current, for example, for a differential input stage of an operational amplifier. This reference current generator can typically be based on a bandgap voltage source powered by the LV or MV supply, which has a supply voltage level, for example, between 1.8 V and 5 V. However, when the integrated electronic device with multiple supply voltages is powered up, in a typical scenario, only the high voltage supply (HV supply) may be available during a first period of time (e.g. between 16 V and 40 V). The MV and LV supplies are only available later, e.g. after several milliseconds. Therefore, in an electronic device that is not adapted according to the present invention, the reference current IR generated by the reference current generator will not be available during this first phase after powering the device up. Only after several milliseconds (i.e. e.g. after more than 10 ms) the LV or MV (LV/MV) supply reaches its target value, which makes IR available to the integrated electronic device only 10 ms after powering up the device. This can cause severe fault conditions in the electronic device and even destroy the device.

A similar fault condition can occur, when one of the LV or MV supplies suddenly drops to zero, which would then cause the reference current IR to drop as well, although the HV voltage supply is still present and vice versa. This situation can also harm the electronic device severely. In order to overcome this problem, the present invention provides a bias current generator, which has two stages and an automatic current selection mechanism which serves to automatically supply any circuitry in the electronic device with the larger of either a current generated by a current generating stage powered by the HV supply or a current generating stage powered by an LV or MV supply. Preferably, the crude bias current generator is supplied by a voltage supply which is present first after powering up the device. This is typically the HV supply out of the multiple voltage supplies.

The two bias current generating stages (i.e. the stage for the crude bias current and the stage for the reference current) are preferably implemented in a different way, where the final reference current to be used during the steady state is generated in a more precise manner while the crude bias current generating stage is supplied by the HV supply and can have a much simpler architecture. For example, the reference current generating stage can be based on a bandgap voltage source. The crude bias current generator can be based on a voltage drop across a zener diode.

According to an aspect of the present invention, the electronic device can further comprise a fault mode voltage supply stage for providing a derived supply voltage for supplying the current selection stage. The fault mode supply voltage stage is adapted to generate the derived supply voltage as long as at least one of the multiple supply voltages is present.

According to this aspect of the present invention, a circuit is provided in the electronic device that derives one supply voltage from the plural supply voltages, which is then used to supply the current selection stage. This provides that regardless of the kind of available voltage supplies (HV or LV or MV), a stable derived voltage supply is provided for the circuit.

According to an aspect of the present invention, the current selection stage can be implemented in the following way. There is a current difference node adapted to provide a difference current of the crude bias current minus the reference current, a summing node for summing the difference current and the reference current and outputting a bias current being the sum of the difference current and the reference current. Further, there is a current mirror coupled between the difference node and the summing node for supplying the difference current to the summing node. This current mirror should be adapted such that the current output from the current mirror to the summing node becomes substantially zero when the reference current is greater than the crude bias current. This means that the difference current is only supplied to the summing node, if the sign of the difference of the crude bias current minus the reference current is positive. If the reference current becomes greater than the crude bias current the difference would become negative and the difference current would have to flow in an opposite direction. Therefore, an effective way of stopping the difference current from flowing in one direction is to implement a diode like element in the current path coupling the difference node to the summing node. In a CMOS implementation this can advantageously be implemented by a diode coupled MOS transistor, which can be part of a current mirror configuration. The output path of the current mirror providing the bias current can be coupled to the summing node. The output path will then stop to source or to sink current, if the reference current exceeds the crude bias current, i.e., if the difference current changes sign. Conventional solutions compare two currents across high impedance nodes by use of comparators. Capacitors having large capacitance values have to be coupled to the high impedance nodes in order to avoid spurious voltage spikes when switching between the different bias currents. An advantage of the solution according to the present invention is that the bias current can change smoothly from the crude bias current to the reference current and vice versa without a need for large capacitors. This aspect of the invention provides a less complex and improved switching mechanism and chip area can be saved.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
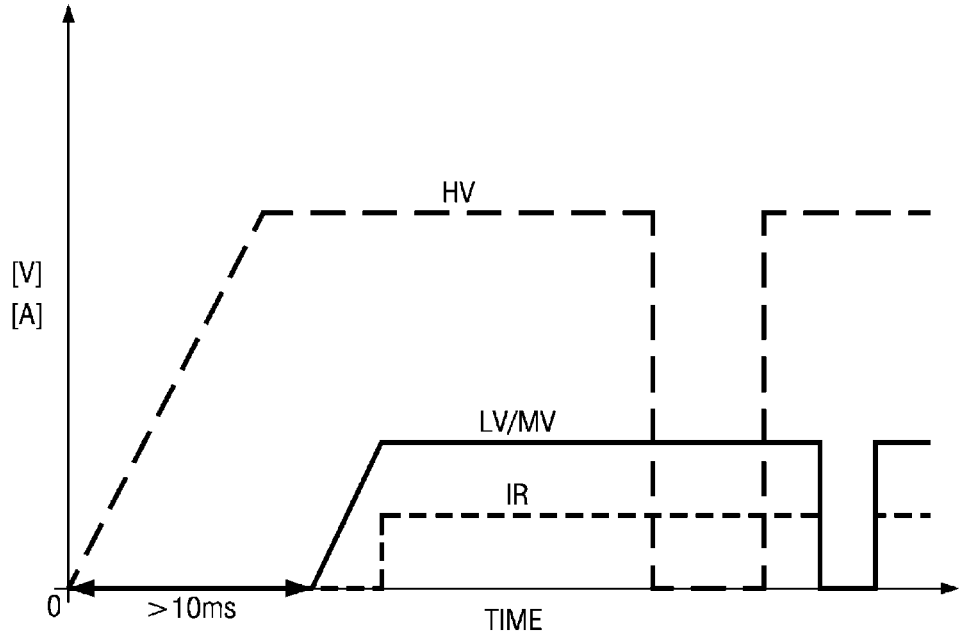
FIG. 1 shows illustrative examples of waveforms of multiple supply voltages in an integrated electronic device with multiple supply voltages.

Refer now to the drawings wherein depicted elements are, for the sake of clarity, not necessarily shown to scale and wherein like or similar elements are designated by the same reference numeral through the several views.

Figure 2:
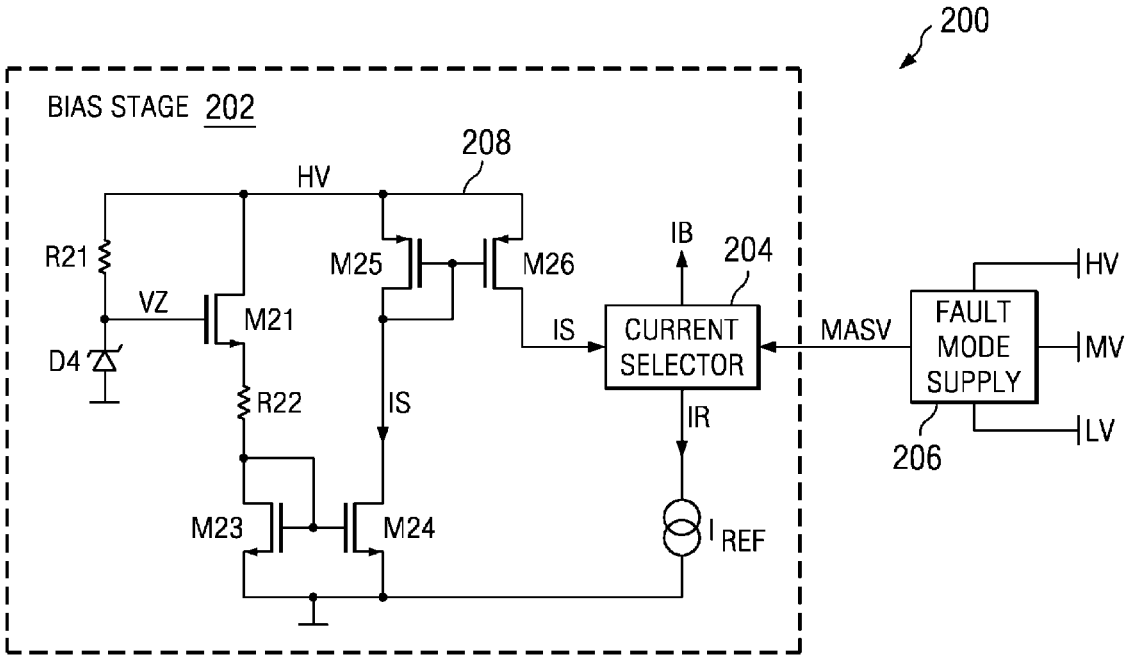
FIG. 2 shows a simplified circuit diagram of a circuitry according to a preferred embodiment of the present invention.

Referring to FIG. 2 of the drawings, the reference numeral 200 generally designates a circuitry for providing a bias current in accordance with a preferred embodiment of the present invention. Circuitry 200 can be implemented in an integrated electronic device having multiple supply voltage domains (i.e., circuitry which is supplied by multiple different supply voltages). For example, three different supply voltages are used with the circuitry 200, which are referred to as HV (e.g., between about 16V and about 40V), MV (e.g., about 5V) and LV (e.g., about 3V). The three supply voltages HV, MV and LV are received by the fault mode supply 206. The fault mode supply 206 provides an output voltage MASV to the bias stage 202, which is derived from the three supply voltages HV, MV and LV.

The bias stage 202 is generally comprised of a crude bias generator and a current selector 204. In operation, current selector 204 receives the derived supply voltage MASV from the fault mode supply 206 and a crude bias or startup current IS from the crude bias generator. Current selector 204 also receives a reference current IR. The reference current IR may be supplied by an external current source (which would then not be part of the electronic device) or the current source $I_{REF}$ and may include a bandgap voltage source and other components. Current selector 204 outputs the bias current IB, which is generated on the basis of the two currents, the reference current IR and the crude bias current IS. Generally, the bias current IB has a value which corresponds to the largest value of currents IS and IR.

The crude bias current generator is generally comprised of two current mirrors, transistors M21, resistors R21 and R22, and the zener diode D4. Voltage rail 208 is supplied with supply HV. The gate voltage VZ for transistor M21 (which is preferably an NMOS FET) is generated by resistor R21 and reverse-bias zener diode D4 (which are coupled between the voltage rail 208 and ground). Generally, diode D4 serves as an overvoltage protection. If voltage (from supply HV) on voltage rail 208 rises and exceeds a certain voltage level defined by the properties of diode D4 and resistor R21, a substantially constant voltage level VZ will be applied to the gate of transistor M21 to actuate transistor M21. The drain-source current of transistor M21 can then flow through resistor R22 and transistor M23 (which is preferably an NMOS FET). Transistor M23 is in diode-connected configuration and forms a current mirror together with transistor M24 (which is preferably an NMOS FET). A startup or crude current IS is provided in the channel of transistor M24, and the current IS is mirrored by the current mirror that is generally comprised of transistors M25 and NM26 (which are preferably PMOS FETs) to the current selector 204. If, for example (as already explained with reference to FIG. 1 above), the voltage level at HV rises earlier than the other voltage levels LV or MV, the current IS will be present, but IR may not yet be supplied to current selector 204. The same situation occurs if LV or MV (whichever is taken to supply the current source $I_{REF}$) suddenly drops below the necessary level for powering the current source $I_{REF}$. Current selector 204 outputs the bias current IB, which is used to supply other parts of the integrated electronic device (not shown), and bias current IB is generally the larger of currents IR and IS.

Figure 3:
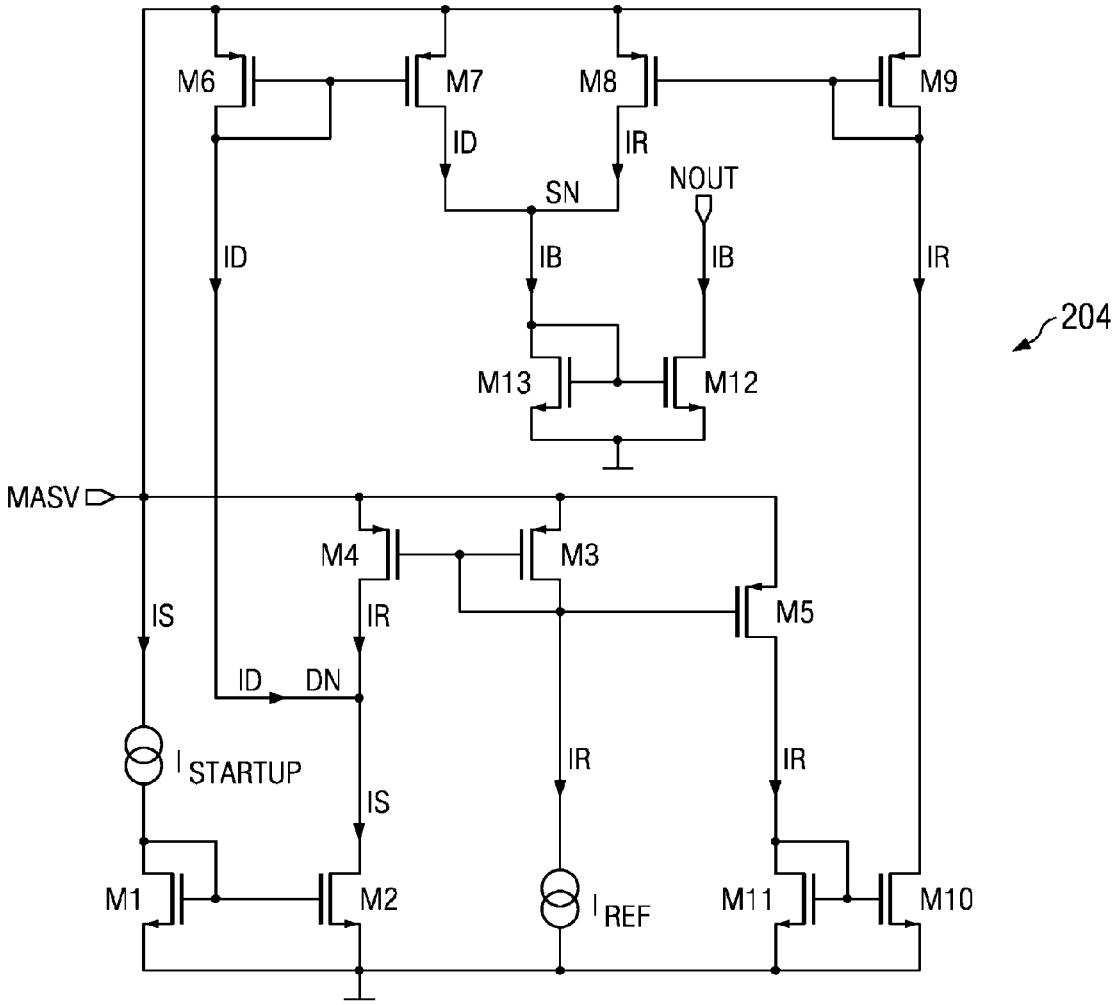
FIG. 3 shows a simplified circuit diagram of a current selector according to a preferred embodiment of the present invention.

Now turning to FIG. 3, a simplified circuit diagram of current selector 204 is shown in accordance with a preferred embodiment of the present invention. Current selector 204 is generally comprised of several current mirrors (preferably seven) and current sources $I_{STARTUP}$ and $I_{REF}$. In FIG. 3, current sources $I_{REF}$ and $I_{STARTUP}$ represent the current sources that provide currents IS and IR. Additionally, current source $I_{STARTUP}$ is preferably the crude current bias generator of FIG. 2.

In operation, current selector 204 has the basic task of providing a bias current IB at its output node NOUT, which corresponds to the larger of reference current IR and the startup current IS. In FIG. 3, current IS provided from source $I_{STARTUP}$ is generally mirrored by a current mirror that is generally comprised of transistors M1 and M2 (which are preferably NMOS FETs), and current IR provided by source $I_{REF}$ is generally mirror by two current mirrors that are comprised of transistors M3, M4, and M5 (which are preferably PMOS FETs). In this configuration, currents IS and IR are mirrored to the difference node DN. Difference node DN is adapted to generate a difference current ID, which is the difference between currents IS and IR. From node DN, the difference current ID mirrored by a current mirror that is generally comprised of transistor M6 and M7 (which are preferably PMOS FETs) to the summing SN. Furthermore, reference current IR (which is supplied by the current mirror that is generally comprised of transistors M3 and M4) is mirror by two current mirrors that are generally comprised of transistors M8 and M9 (preferably PMOS FETs) and transistors M10 and M11 (preferably NMOS FETs). This allows current IR to be provided to the summing node SN so as to generate a bias current IB, which is generally the sum of the difference current ID and the reference current IR. The bias current IB is then mirrored by another current mirror that is generally comprised of transistors M13 and M12 (preferably NMOS FETs) and provide to output node NOUT.

This bias current IB is, thus, the sum of the difference current ID and the reference current IR. If the startup current IS is greater than the reference current IR, the difference current ID is positive and the difference current ID flows through transistor M6 in the direction indicated in FIG. 3, so the positive difference between the startup current IS and the reference current IR is added to the reference current IR to make the bias current IB be generally equal to the startup current IB. If the startup current IS is less than the reference current IR, difference current ID would be negative; however, transistor M6 is diode-connected. Thus, a negative difference current ID cannot flow through transistor M6, meaning that the bias current IB would generally be equal to the reference current IR. Accordingly, the bias current IB is generally equal to the larger of the startup current IS and the reference current IR. Additionally, the target value of the reference current IR can preferably be designed to be greater than the target value of startup current IS so that if both currents IS and IR settle to their respective target values during a steady-state phase of the circuit 200 then the bias current IB generally equals reference current IR. However, if reference current IR suddenly drops and the startup current IS is present, then the bias current IB will generally assume the value of the startup current IS.

Additionally, in a simplified implementation, the gate of transistor M3 may be directly coupled to the gates of transistor M8 and M5, and transistors M11, M10 and M9 may be omitted. However, in the simplified configuration noise may couple more easily from transistor M3 to transistor M8. In other words, the additional current mirrors M5, M11, M10, M9 provide improved noise suppression.

Figure 4:
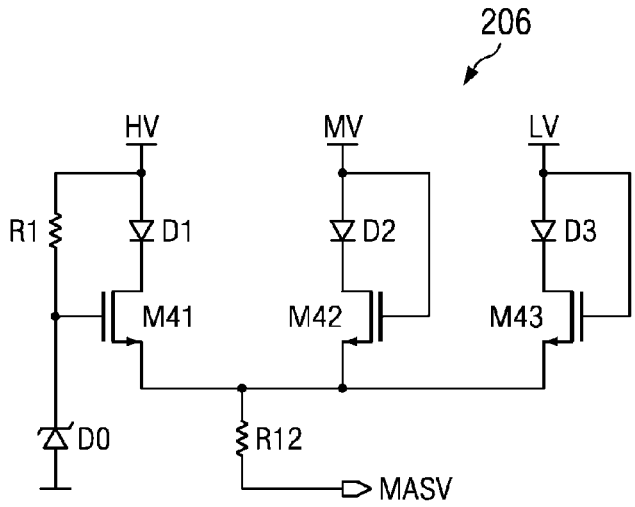
FIG. 4 shows a simplified circuit diagram of a fault mode voltage supply stage according to a preferred embodiment of the present invention.

The current selector 204 can be supplied with a voltage MASV from the fault mode voltage supply 206. As can be seen in FIG. 4, a simplified circuit diagram of the fault mode voltage supply 206 is shown in accordance with a preferred embodiment of the present invention. The supply 206 generally comprises transistor M41, M42, and M43 (preferably NMOS FETs), diodes D0, D1, D2, and D3, and resistors R1 and R12.

The supply 206 generally serves to provide a stable supply voltage MASV, which is generally present as long as at least one of the multiple supply voltages HV, LV or MV is present. Typically, voltage supply HV is expected to rise and reach a sufficient (or target) voltage level earlier than supplies LV and MV after power up. Therefore, zener diode D0 and resistor R1 are generally used to control the gate voltage of transistor M41. The drain-source current through transistor M41 can then be used to provide and establish the supply voltage MASV. However, if supply HV suddenly drops below a threshold voltage level, the voltage MASV can be derived from the supply MV or supply LV. This principle would be generally applicable to two supply voltages (i.e., supplies HV and MV or supplies HV and LV) as well as to three (as shown in FIG. 4) or more supplies. The supply 206 generally assures that the voltage MASV has a sufficient voltage level and is not zero, as long as at least one of the voltage levels of the different supplies HV, MV, and LV is high enough to drive current through the respective transistors M41, M42, and M43 and resistor R12. Diodes D1, D2 and D3 are provided to generally prevent current from flowing back into the respective other voltage supplies (HV, MV, or LV) having a lower voltage level. Transistors M42 and M43 are respectively coupled to MV and LV as M41 is coupled to HV. The currents generated by transistors M41, M42, and M43 are generally summed, and the voltage drop across resistor R12 can be used to supply the voltage MCSS as shown in FIG. 3. Additionally, the dimension of transistor M42 can be set to be proportional to the width-to-length ratio (W/L) of transistor M41 in order to generate sufficient high voltage MASV if supply HV is not available. The different dimensions generally take into account the fact that the voltage level from supply HV is generally greater than the voltage level from supply MV. Accordingly, the same principle (i.e. different aspect ratios of the transistors) is applicable with respect to the other supplies as well.

Figure 5:
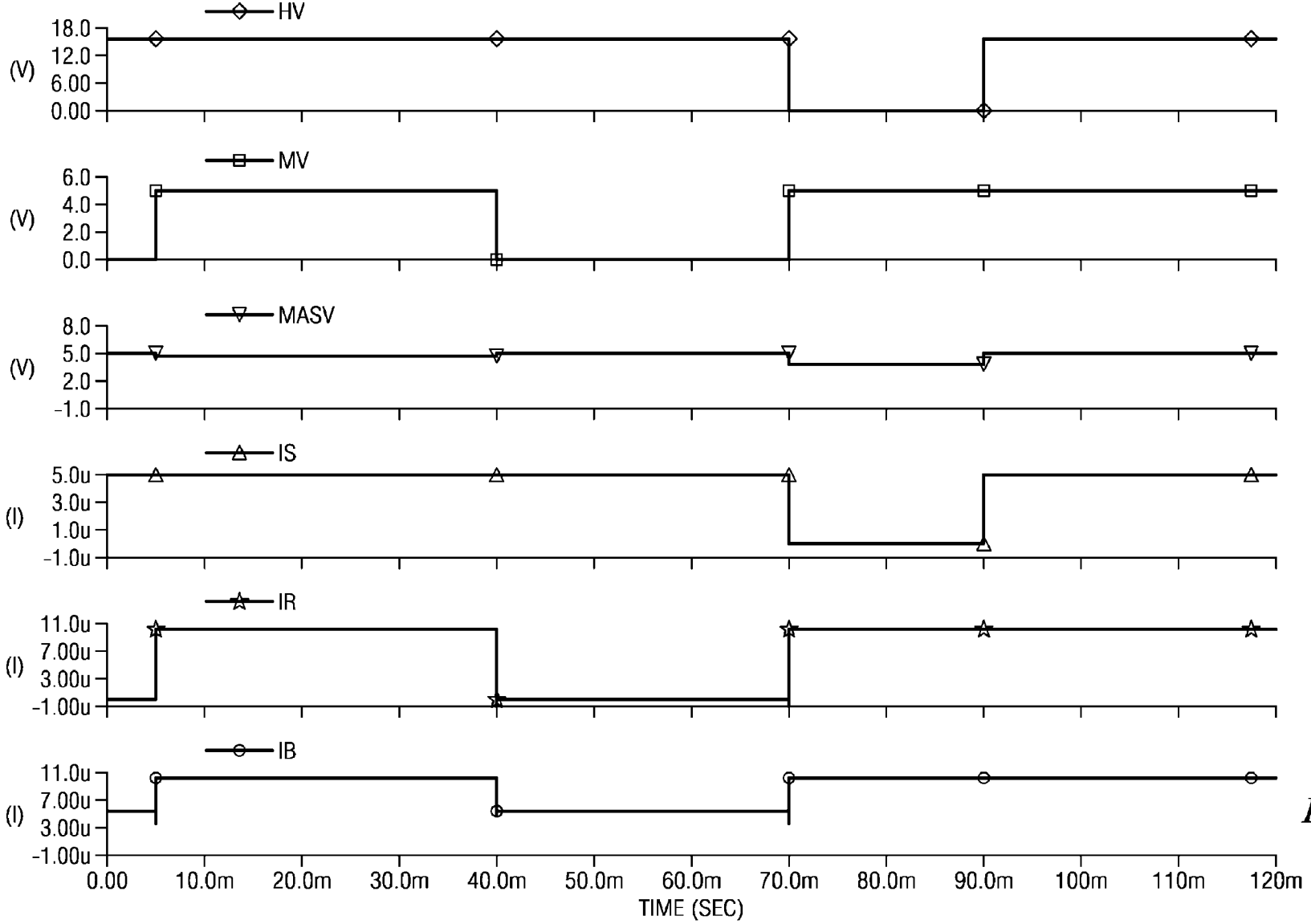
FIG. 5 shows waveforms illustrating operation of the circuits shown in FIGS. 2 to 4.

FIG. 5 shows waveforms relating to signals of the circuit 200 shown in FIGS. 2 to 4. The a voltage from voltage supply HV is present at time 0. As an example, the voltage from supply MV is indicated being lower than the voltage from supply HV. The voltage from supply MV rises about 5 ms. The startup current IS is present simultaneously to the voltage from supply HV as the startup current IS is generated by use of supply HV as shown in FIG. 2. However, the reference current IR is generated by use of supply MV and therefore delayed until the voltage from supply MV is present. Therefore, reference current IR is also delayed by about 5 ms.

Startup current IS has a target value of about 5 μA. Reference current IR has a target value of about 10 μA. Current IR and IS are supplied to the selector 204 to generate the bias current IB. The bias current IB is the shown as being the larger of currents IS and IR. Within the first 5 ms, the startup current IS is greater than reference current IR. As a consequence, bias current IB assumes the value of the startup current IS. After 5 ms, the reference current IR reaches its target value, and the bias current assumes the value of the reference current. Thus, FIG. 5 illustrates that the bias current IB generally assumes the value of the larger of currents IS and IR. Moreover, undefined voltage levels are generally avoided and fault conditions caused by sudden voltage drops of either of the supply voltage levels are generally prevented.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus that is coupled to a plurality of power sources and that provides a bias current, the apparatus comprising:

a crude bias generator that generates a startup current and that is coupled to at least one of the power sources;

a current selector that receives the startup current and a reference current, wherein the current selector outputs the larger of the startup current and the reference current as the bias current; and a fault mode supply that is coupled to each power source and that generates a supply voltage for the current selector, wherein the fault mode supply includes:

a diode that is coupled to the largest of the power sources;

a first resistor that is coupled to the largest of the power sources;

an FET that is coupled to the diode at its drain and that is coupled to the resistor at its gate;

a zener diode coupled between the gate of the FET and ground; and a second resistor that is coupled to the source of the FET and that is coupled to the current selector.

2. The apparatus of claim 1, wherein the fault mode supply further comprises a branch coupled to each of the remaining power sources, wherein each branch includes:

a second diode coupled to its power source; and a second FET that is coupled to its power source at its gate, that is coupled to the second diode at its drain, and that is coupled to the second resistor at its source.

3. The apparatus of claim 1, wherein the current selector further comprises:

a first current minor that receives the startup current;

a second current mirror that receives the reference current and that is coupled to the first current mirror at a difference node;

a third current minor that is coupled to the difference node and that receives a difference current; and a fourth current mirror that receives the reference current and that is coupled to the third current minor at a summing node that adds the reference current to the difference between the startup current and the reference current if the startup current is greater than the reference current, wherein the bias current is output from the summing node.

4. The apparatus of claim 3, wherein the current selector further comprises a fifth current source that is coupled to the summing node and that outputs the bias current.

5. The apparatus of claim 3, wherein the supply voltage from the fault mode supply is input into the second current mirror.

6. The apparatus of claim 1, wherein the crude bias generator further comprises:

a first resistor that is coupled to the largest of the power supplies;

a zener diode that is coupled between the first resistor and ground;

a FET that is coupled to the largest of the power supplies at its drain and that is coupled to a node between the first resistor and the zener diode at its gate;

a second resistor that is coupled to the source of the FET;

a first current minor that is coupled to the second resistor; and a second current mirror that is coupled to the first current mirror and that outputs the startup current.

7. An apparatus that is coupled to a plurality of power sources and that provides a bias current, the apparatus comprising:

a current source that generates a startup current;

a first current minor that receives the startup current;

a second current mirror that receives a reference current and that is coupled to the first current mirror at a difference node;

a third current minor that is coupled to the difference node and that receives a difference current; and a fourth current mirror that receives the reference current and that is coupled to the third current minor at a summing node that adds the reference current to the difference between the startup current and the reference current if the startup current is greater than the reference current, wherein the bias current is output from the summing node; and a fault mode supply that is coupled to each power source and that generates a supply voltage for the second current minor.

8. The apparatus of claim 7, wherein the fault mode supply further comprises:

a diode that is coupled to the largest of the power sources;

a first resistor that is coupled to the larges of the power sources;

an FET that is coupled to the diode at its drain and that is coupled to the resistor at its gate;

a zener diode coupled between the gate of the FET and ground; and a second resistor that is coupled to the source of the FET and that is coupled to the current selector.

9. The apparatus of claim 8, wherein the fault mode supply further comprises a branch coupled to each of the remaining power sources, wherein each branch includes:

a second diode coupled to its power source; and a second FET that is coupled to its power source at its gate, that is coupled to the second diode at its drain, and that is coupled to the second resistor at its source.

10. The apparatus of claim 7, wherein the current source further comprises:

a first resistor that is coupled to the largest of the power supplies;

a zener diode that is coupled between the first resistor and ground;

a FET that is coupled to the largest of the power supplies at its drain and that is coupled to a node between the first resistor and the zener diode at its gate;

a second resistor that is coupled to the source of the FET;

a fifth current mirror that is coupled to the second resistor; and a sixth current minor that is coupled to the first current minor and that outputs the startup current.

11. The apparatus of claim 7, wherein the apparatus further comprises a fifth current source that is coupled to the summing node and that outputs the bias current.

12. The apparatus of claim 7, wherein the first current mirror further comprises:

a first NMOS FET that is diode-connected; and a second NMOS FET that is coupled to the gate of the first NMOS FET at its gate and that is coupled to the source of the first NMOS FET at its source.

13. The apparatus of claim 7, wherein the second, third, and fourth current minors further comprise:

a first PMOS FET that is diode-connected; and a second PMOS FET that is coupled to the gate of the first PMOS FET at its gate and that is coupled to the source of the first PMOS FET at its source.

14. An apparatus that provides a bias current, the apparatus comprising:

a crude bias generator that generates a startup current and that is coupled to a first power source;

a first current minor that receives the startup current;

a second current mirror that receives a reference current and that is coupled to the first current mirror at a difference node;

a third current minor that is coupled to the difference node and that receives a difference current; and a fourth current mirror that receives the reference current and that is coupled to the third current minor at a summing node that adds the reference current to the difference between the startup current and the reference current if the startup current is greater than the reference current, wherein the bias current is output from the summing node; and a fault mode supply that generates a supply voltage for the second current mirror, wherein the fault mode supply includes:

a first diode that is coupled to the first power source;

a first resistor that is coupled to the first power source;

a first NMOS FET that is coupled to the diode at its drain and that is coupled to the resistor at its gate;

a zener diode coupled between the gate of the FET and ground;

a second resistor that is coupled to the source of the FET and that is coupled to the current selector;

a second diode coupled to a second power source; and a second NMOS FET that is coupled to its power source at its gate, that is coupled to the second diode at its drain, and that is coupled to the second resistor at its source.

15. The apparatus of claim 14, wherein the crude bias generator further comprises:

a first resistor that is coupled to the largest of the power supplies;

a zener diode that is coupled between the first resistor and ground;

a FET that is coupled to the largest of the power supplies at its drain and that is coupled to a node between the first resistor and the zener diode at its gate;

a second resistor that is coupled to the source of the FET;

a fifth current mirror that is coupled to the second resistor; and a sixth current minor that is coupled to the first current minor and that outputs the startup current.

16. The apparatus of claim 14, wherein the apparatus further comprises a fifth current source that is coupled to the summing node and that outputs the bias current.

17. The apparatus of claim 14, wherein the first current mirror further comprises:

a first NMOS FET that is diode-connected; and a second NMOS FET that is coupled to the gate of the first NMOS FET at its gate and that is coupled to the source of the first NMOS FET at its source.

18. The apparatus of claim 14, wherein the second, third, and fourth current minors further comprise:

a first PMOS FET that is diode-connected; and a second PMOS FET that is coupled to the gate of the first PMOS FET at its gate and that is coupled to the source of the first PMOS FET at its source.

* * * * *